United States Patent [19]

Carr et al.

[11] Patent Number: 4,899,464

[45] Date of Patent: Feb. 13, 1990

[54] DRYER OUTLET GRILL WITH SENSOR

[75] Inventors: Keith E. Carr, Lincoln Township, Berrien County; Karl Jautakis, Chikaming Township, Berrien County, both of Mich.

[73] Assignee: Whirlpool Corporation, Benton Harbor, Mich.

[21] Appl. No.: 270,670

[22] Filed: Nov. 14, 1988

[51] Int. Cl.[4] ..... F26B 11/02; F26B 21/06

[52] U.S. Cl. ..... 34/133; 34/46; 34/50

[58] Field of Search ..... 34/133, 55, 43, 48, 34/50, 44, 45

[56] References Cited

U.S. PATENT DOCUMENTS 3,593,571 7/1971 Wiechert .
4,754,556 7/1988 Carr .

FOREIGN PATENT DOCUMENTS 131563 11/1978 Japan ..... 34/55

*Primary Examiner*—Henry A. Bennet

[57] ABSTRACT

A moisture sensor assembly is provided for an automatic dryer wherein sensor strips are secured directly to the drum outlet grill for engagement by the materials being dried. The sensor strips pivotally engage at one end with the grill and have an interference friction fit at an opposite end so that the strips are held in place without additional fasteners. Electrical connection of the sensor strips occurs in a protected zone, physically separated from the moist exhaust air stream.

22 Claims, 2 Drawing Sheets

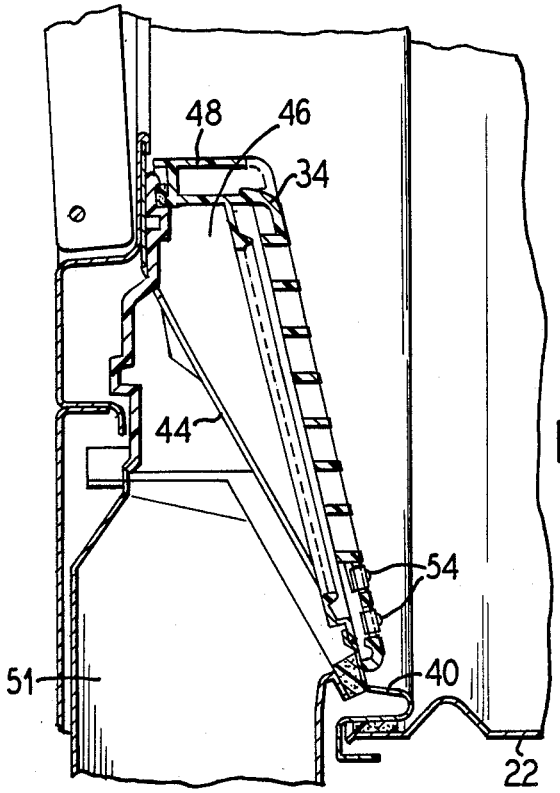
FIG. 3
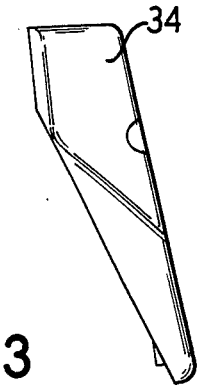
FIG. 5
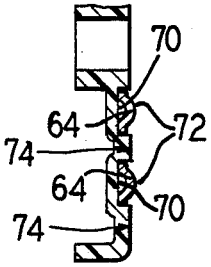
FIG. 6
FIG. 4
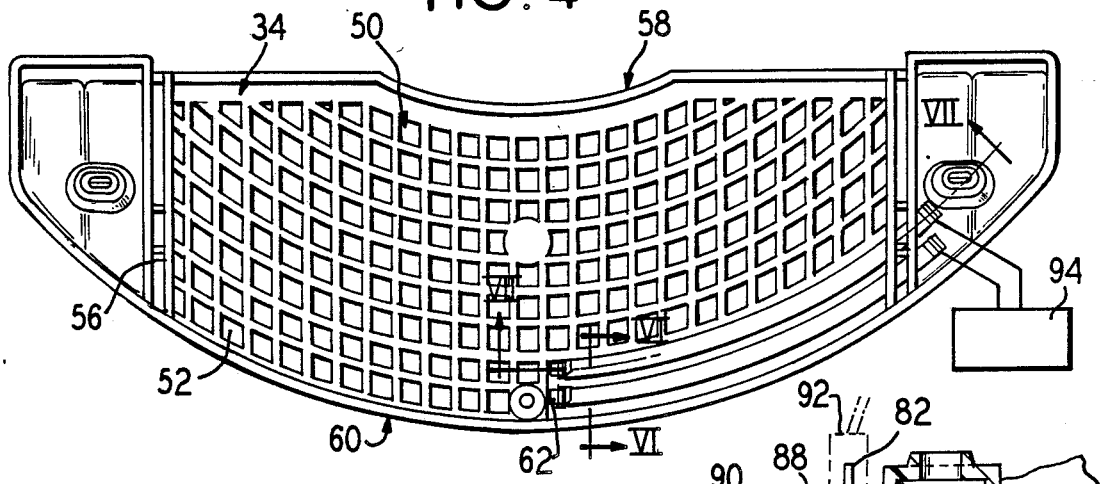
FIG. 7
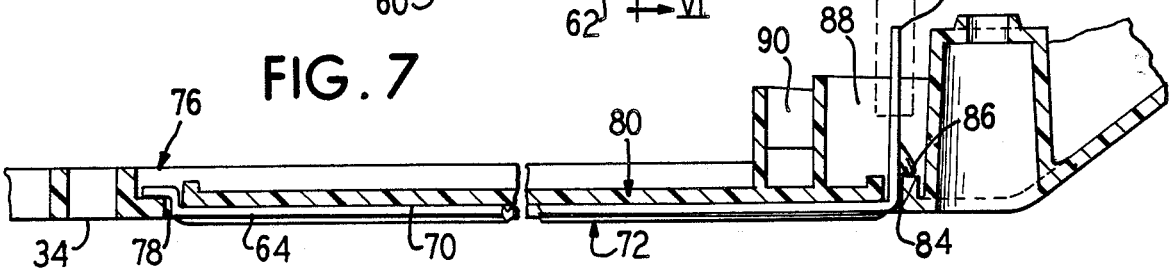
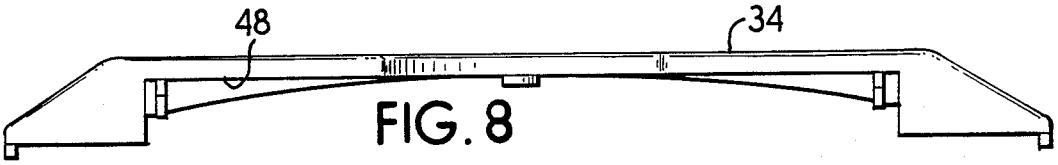
FIG. 8

DRYER OUTLET GRILL WITH SENSOR

BACKGROUND OF THE INVENTION

The present invention is directed to a sensing assembly for determining the moisture content of the material being dried in a domestic laundry drying apparatus.

Dryer sensor assemblies are known in the art, such as for example that disclosed in U.S. Pat. No. 3,593,571, assigned to the assignee of the present invention. That sensor assembly incorporates a bridging-type sensor assembly for use in a domestic laundry dryer wherein a pair of sensing elements having leg portions extend through an insulating mounting base and through a bulkhead of a drying chamber for engagement by resilient clips which secure the sensing assembly onto the bulkhead. In the arrangement disclosed in that patent, the sensing elements are mounted on a separate mounting post and are secured in place by clips engaging on the opposite side of the bulkhead. The sensor operates to detect moisture by sensing a current flow between the pair of sensor elements when bridged by wet or damp material.

In an axial flow dryer, where the heated air is directed into the interior of the rotating drum through a rear bulkhead and is directed out of the drum at a front side of the drum, the fabric being dried within the drum is naturally carried toward the front of the drum by the axial air flow. Thus, the mounting of the sensor at the rear bulkhead becomes less effective, particularly in small fabric loads in that there may be occasions where long time periods exist wherein the fabric does not engage the rear bulkhead. Such an occurrence would provide an erroneous reading if the moisture sensor were secured to the rear bulkhead.

Additionally, the use of a separate mounting base member and securing clips requires a labor and material intensive assembly of multiple parts.

Therefore, it would be an improvement in the art if there were provided a sensing assembly for determining the moisture content of material within the dryer which is positioned in a location to be continuously in engagement with the material being dried and which would incorporate a reduced number of assembly pieces to provide a more efficient and economical assembly of the sensor apparatus.

SUMMARY OF THE INVENTION

It is an object of the present invention to provide a sensor assembly for an automatic axial flow dryer that is accurate for all load sizes.

It is a further object of the invention to provide a sensor assembly that is inexpensive to manufacture and assemble.

It is a still further object of the invention to provide a sensor assembly that includes sensor elements which can be secured within the dryer drum without additional fasteners.

The present invention provides a sensor assembly for use in an automatic dryer in which the sensor is mounted directly to the dryer outlet grill which is positioned at the front side of the dryer drum, thus assuring that the material within the dryer will be in constant contact with the sensor. The air flow in the dryer is directed toward the outlet grill, thus the material will always be pulled toward the sensor.

The sensor strips are attached to the outlet grill in a very simple manner by a pivoting interference connection at a first end and a slip through friction and detent connection at the opposite, second end. The electrical connection is provided by a simple slip-on plug at the second end of the sensor strips.

The dryer outlet grill is secured to the front bulkhead of the dryer by three threaded fasteners and the electrical connection of the sensor occurs in a protected area behind the outlet grill spaced away and shielded from the exhaust air flow.

The sensor assembly in the outlet grill thus provides a reliable and accurate sensing apparatus which can be assembled without the need for additional assembly pieces and fasteners thereby resulting in a sensor assembly which is easily and economically assembled.

BRIEF DESCRIPTION OF THE DRAWINGS

FIG. 3 is a side sectional view taken generally along the line III—III of FIG. 2.

FIG. 4 is a front elevational view of the dryer outlet grill taken alone.

FIG. 5 is a side elevational view of the dryer exhaust grill of FIG. 4.

FIG. 6 is a sectional view taken generally along the line VI—VI of FIG. 4.

FIG. 7 is a sectional view taken generally along the line VII—VII of FIG. 4.

FIG. 8 is a top elevational view of the dryer outlet grill of FIG. 4.

BRIEF DESCRIPTION OF THE DRAWINGS

Figure 1:
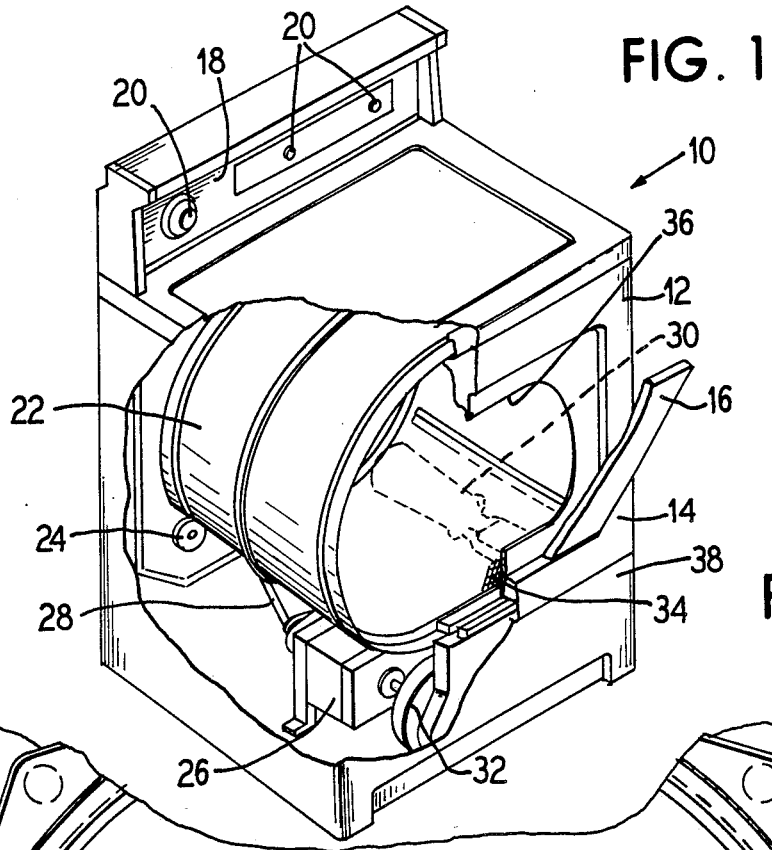
FIG. 1 is a perspective view of an automatic dryer embodying the principles of the present invention.

In FIG. 1 there is illustrated an automatic dryer generally at 10 which embodies the principles of the present invention. The dryer has an outer cabinet 12 including a front panel 14 with an openable door 16 therein. A control console 18 is located at the top rear of the cabinet 12 and includes a plurality of controls 20 for operating the dryer through a pre-programmed series of drying steps.

Within the cabinet 12 there is mounted a horizontally rotatable drum 22 which is carried on four idler rollers 24. A motor 26 drives a belt 28 which encircles the drum 22 to cause the drum to rotate. A heater 30 is utilized to heat air which is drawn through the dryer drum by a blower 32 operated by the motor 26. The heated air enters the drum through a rear bulkhead (not shown) and exits the drum at a lower front edge of the drum through a dryer outlet grill 34 within which is carried a removable lint filter (not shown, but see U.S. Pat. No. 4,770,925). Thus, the dryer is an axial air flow or flow-through dryer in that the heated air enters the drum 22 from the rear stationary bulkhead and exits the drum near a front edge of the drum after flowing in a generally axial direction.

Figure 2:
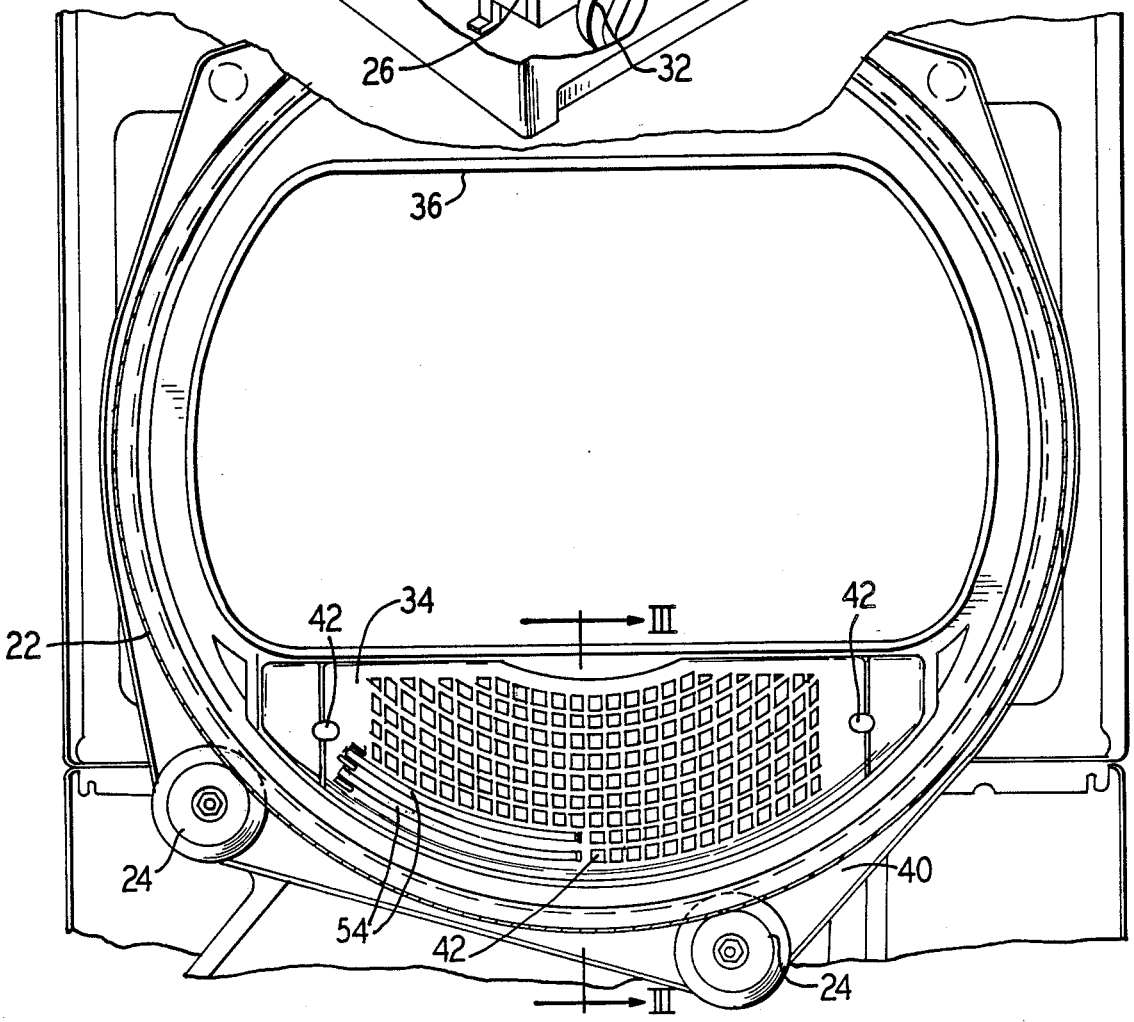
FIG. 2 is a partial sectional view of the dryer taken from the interior of the drum.

FIG. 2 illustrates a view from the interior of the drum 22 looking out through an opening 36 in a front panel 38 of the cabinet 12 which is closed by the door 16 while the dryer is in use. At a lower edge of the opening 36 the exhaust outlet grill 34 is shown. The exhaust outlet grill comprises a one piece member fabricated of an electrically insulating material such as plastic which is secured to a stationary front bulkhead 40 of the dryer by a plurality of threaded fasteners 42. The threaded fasteners are received in the exhaust grill in a recessed manner so that the heads of the fasteners are not engageable by the materials being dryed within the drum. This prevents any abrasion of the materials. As best shown in FIG. 3 the outlet grill 34 is spaced from the front bulkhead 40 and is positioned over an exhaust outlet duct opening 44 so that a space 46 is provided for insertion of a lint screen (not shown). The outlet grill 34 has an open top at 48 which permits insertion of the lint screen.

The outlet grill 34 is shown in greater detail in FIGS. 3–8 where it is seen that the grill has a large central area 50 comprising a grid of relatively large openings 52 for passage of the moist air from the drum 22 into an exhaust duct 54. Although the openings 52 are shown as being a series of rows and columns of openings formed by vertical side walls 56 and arcuate top 58 and bottom walls 60, the openings could be of any geometric configuration which would provide a relatively uninhibited flow of air from the dryer drum.

Mounted on to the outlet grill along a lower edge 62 thereof are two elongated and spaced apart metal sensor strips 64 which provide a moisture detecting function. The dryer outlet grill 34 has two relatively shallow channels 70 formed therein of an arcuate shape along their axial length to receive the sensor strips 64. The sensor strips have a thickness, preferably formed by a contour of the strip (see FIG. 6) which results in a forward edge 72 of the strip being at an elevation slightly above a surrounding surface 74 of the outlet grill. Thus, contact of the sensor strips by the materials within the drum will be enhanced and assured. The sensor strips 64 are located closely adjacent to the air flow openings 52 in the outlet grill so that materials drawn toward the outlet openings will be in continuous contact with the sensors.

The sensor strips 64 are attached to the outlet grill 34 in a very simple manner. A first end 76 of the strip 54 has a double L bend formed therein and the outlet grill 34 has an aperture 78 formed therein just slightly larger than the cross-sectional area of the strip 64 such that the first end 76 of the strip 64 is inserted into the aperture 78 with the length of the strip perpendicular to a face 80 of the outlet grill 34. The strip is then rotated so that a second end 82 is pivoted toward the face 80 of the outlet grill 34. As this occurs, the strip 64 lays down into the channel 70 formed in the outlet grill 34. The second end 82 is inserted or slipped through an aperture 84 which is dimensioned for a snug fit with the sensor strip 64. The second end 82 includes a detent 86 which engages the outlet grill to prevent the strip end from becoming disengaged from the outlet grill. Thus, the sensor strip is held in the channel without need for additional fasteners.

The aperture 84 which receives the second end 82 of the sensor strip 64 is located in a chamber 88 which is shielded from the opening area 50 of the outlet grill 34 by at least one vertical wall member 90. Thus, the second end 82 is not positioned within the exhaust air flow. An electrical connector 92 is readily slipped onto the second end 82 of the sensor strip to provide electrical current to one of the sensor strips from a control 94 and to conduct a return flow of current from the second sensor strip to the control upon the bridging of the two sensor strips by a wet or damp, and thus conducting, material. Therefore, the electrical connection of the sensor strips occurs in a protected zone away from the moist exhaust air flow.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. A sensor assembly for use in an automatic dryer having a rotatable dryer drum for containing a supply of material to be dried, and an exhaust duct opening for exhausting an air stream from said drum, said sensor assembly comprising:

an electrically non-conductive exhaust outlet grill covering said exhaust duct opening and having a plurality of openings formed therein; and a pair of spaced apart elongated sensor strips each secured directly to said exhaust outlet grill closely adjacent said plurality of openings and closely adjacent said rotatable dryer drum and exposed to the interior of said drum for intermittent contact by said material.

2. A sensor assembly according to claim 1, wherein a first end of each of said sensor strips is pivotally engaged with said exhaust outlet grill and a second end of each of said sensor strips has a slip fit connection with said exhaust outlet grill.

3. A sensor assembly according to claim 2, wherein each of said second ends further includes a detent engageable with said exhaust outlet grill to assure retention of said sensor strips on said exhaust outlet grill.

4. A sensor assembly according to claim 1, wherein said exhaust outlet grill provides a space for a lint screen in said air stream and includes an integrally formed zone physically separated from said air stream, each of said second ends of said sensor strips having an electrical connection occurring in said zone.

5. A sensor assembly according to claim 1, wherein said exhaust outlet grill has two adjacent recessed channels formed integrally therein for receiving said sensor strips.

6. A sensor assembly according to claim 5, wherein said sensor strips are profiled such that at least a portion of each strip protrudes from said respective channels beyond a surrounding surface of said exhaust outlet grill into the interior of said rotatable drum.

7. A flow-through dryer, comprising:

a cabinet;

a dryer drum rotatably mounted in said cabinet for receiving articles to be dried and accessible by said openable door;

means for rotating said dryer drum;

a first bulkhead including air inlet means in communication with the interior of said dryer drum;

means of providing heated air to said air inlets;

a second bulkhead including an openable door;

an electrically non-conductive exhaust outlet grill mounted to said second bulkhead below said door, said exhaust outlet grill having a plurality of air outlets formed therein, each of said air outlets communicating with the interior of said dryer drum; and a pair of spaced apart elongated sensor members each secured directly to said exhaust outlet grill closely adjacent said air outlets and closely adjacent said dryer drum, said sensor members being exposed to the interior of said drum for intermittent contact by said articles.

8. A flow-through dryer according to claim 7, wherein said sensor members comprise elongated arcuate electrically conductive strips.

9. A flow-through dryer according to claim 7, wherein a first end of each of said sensor members is pivotally engaged with said exhaust outlet grill, and a second end of each of said sensor members has a slip fit connection with said outlet grill.

10. A flow-through dryer according to claim 9, wherein each of said second ends with said slip connection further comprises a detent engageable with said exhaust outlet grill to assure retention of said sensor strips on said exhaust outlet grill.

11. A flow-through dryer according to claim 7, wherein said exhaust outlet grill provides a space for a lint screen in said air stream and includes an integrally formed zone physically separated from said air stream, and each of said second ends of said sensor strips having an electrical connection occurring in said zone.

12. A flow-through dryer according to claim 7, wherein said exhaust outlet grill has two adjacent recessed channels formed therein for receiving said sensor members.

13. A flow-through dryer according to claim 12, wherein said sensor members are profiled such that at least a portion of each of said members protrudes beyond a surrounding surface of said exhaust outlet grill.

14. An exhaust outlet grill assembly for use in an automatic dryer including a rotatable drum having a cylindrical wall for receiving a supply of material to be dried, an inlet to said drum for admission of an air stream and an exhaust duct opening for exhausting said air stream from said drum, said exhaust outlet grill assembly comprising:

an electrically non-conductive exhaust outlet grill main body covering said exhaust duct opening and having a plurality of exhaust apertures formed thereon; and a pair of spaced apart arcuately shaped sensor members each attached directly to said outlet grill without the use of additional fasteners, each of said sensor members being disposed closely adjacent to such plurality of exhaust apertures and closely adjacent to the cylindrical wall of said drum.

15. An exhaust outlet grill assembly according to claim 14, wherein a first end of each of said sensor strips is pivotally engaged with said exhaust outlet grill and a second end of each of said sensor strips has a slip fit connection with said exhaust outlet grill.

16. An exhaust outlet grill assembly according to claim 15, wherein each of said second ends further include a detent engageable with said exhaust outlet grill to assure retention of said sensor strips on said exhaust outlet grill.

17. An exhaust outlet grill assembly according to claim 14 wherein said exhaust outlet grill provides a space for a lint screen in said air stream and includes an integrally formed zone physically separated from said air stream, each of said second ends of said sensor strips having an electrical connection occurring in said zone.

18. A sensor assembly according to claim 14, wherein said exhaust outlet grill has two adjacent recessed channels formed integrally therein for receiving said sensor strips.

19. An exhaust outlet grill assembly according to claim 18, wherein said sensor strips are profiled such that at least a portion of each strip protrudes from said respective channels beyond a surrounding surface of said exhaust outlet grill into the interior of said rotatable drum.

20. An exhaust outlet grill assembly according to claim 18, wherein said exhaust outlet grill provides a space for a lint screen and said air stream and includes an integrally formed zone physically separated from said air stream, each of said second ends of said sensor strips having an electrical connection occurring in said zone.

21. A exhaust outlet grill assembly according to claim 18, wherein a first end of each of said sensor strips is pivotally engaged with said exhaust outlet grill in the second end of each of said sensor strips has a slip fit connection with said exhaust outlet grill.

22. A sensor assembly according to claim 1, wherein each of said sensors is arcuately shaped, said sensors being arcuately aligned with said rotatable dryer drum.

* * * * *